US005771706A

United States Patent [19]

Lavigne

[11] Patent Number: 5,771,706

[45] Date of Patent: Jun. 30, 1998

[54] ICE SKATING RINK

[76] Inventor: Peter P. Lavigne, 38 Moynes Ave., Etobicoke, Ontario, Canada, M8Y 3B8

[21] Appl. No.: 821,209

[22] Filed: Mar. 20, 1997

[51] Int. Cl.[6] ..... F25C 3/02

[52] U.S. Cl. ..... 62/235; 403/294; 472/92

[58] Field of Search ..... 62/235; 52/480, 52/586.1, 586.2; 472/92, 94; 403/292, 294

[56] References Cited

U.S. PATENT DOCUMENTS

| | | | |
|---|---|---|---|
| 2,882,564 | 4/1959 | Couse et al. | 52/586.1 |
| 3,379,031 | 4/1968 | Lewis, Jr. | 62/235 |
| 3,950,915 | 4/1976 | Cole | 52/586.2 |
| 4,169,688 | 10/1979 | Toshio | 52/586.1 |
| 4,599,841 | 7/1986 | Haid | 52/586.2 |
| 5,592,794 | 1/1997 | Tundaun | 52/586.1 |
| 5,623,803 | 4/1997 | Willis | 52/480 |
| 5,651,220 | 7/1997 | Dit Felis | 52/586.1 |

*Primary Examiner*—William E. Tapolcai

[57] ABSTRACT

A new ice skating rink for easily and conveniently forming a sheet of ice for ice skating. The inventive device includes a plurality of water holding trays disposed on the ground and connected together using connectors. When the water within the trays freezes, a substantially continuous sheet of ice is formed.

5 Claims, 3 Drawing Sheets

ICE SKATING RINK

BACKGROUND OF THE INVENTION

1. Field of the Invention

The present invention relates to skating rinks and more particularly pertains to a new ice skating rink for easily and conveniently forming a sheet of ice for ice skating.

2. Description of the Prior Art

The use of skating rinks is known in the prior art. More specifically, skating rinks heretofore devised and utilized are known to consist basically of familiar, expected and obvious structural configurations, notwithstanding the myriad of designs encompassed by the crowded prior art which have been developed for the fulfillment of countless objectives and requirements.

Known prior art skating rinks include U.S. Pat. No. 5,134,857; U.S. Pat. No. 4,815,301; U.S. Pat. No. 3,930,647; U.S. Pat. No. 3,933,002 and U.S. Pat. No. 5,087,030. In addition, U.S. Pat. Des. 353,214 teaches a barrier for a yard which could be used to form the border of a skating rink.

While these devices fulfill their respective, particular objectives and requirements, the aforementioned patents do not disclose a new ice skating rink. The inventive device includes a plurality of water holding trays disposed on the ground and connected together using connectors. When the water within the trays freezes a substantially continuous sheet of ice is formed.

In these respects, the ice skating rink according to the present invention substantially departs from the conventional concepts and designs of the prior art, and in so doing provides an apparatus primarily developed for the purpose of easily and conveniently forming a sheet of ice for ice skating.

SUMMARY OF THE INVENTION

In view of the foregoing disadvantages inherent in the known types of skating rinks now present in the prior art, the present invention provides a new ice skating rink construction wherein the same can be utilized for easily and conveniently forming a sheet of ice for ice skating.

The general purpose of the present invention, which will be described subsequently in greater detail, is to provide a new ice skating rink apparatus and method which has many of the advantages of the skating rinks mentioned heretofore and many novel features that result in a new ice skating rink which is not anticipated, rendered obvious, suggested, or even implied by any of the prior art skating rinks, either alone or in any combination thereof.

To attain this, the present invention generally comprises a plurality of water holding trays disposed on the ground and connected together using connectors. When the water within the trays freezes a substantially continuous sheet of ice is formed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ice skating rink apparatus and method which has many of the advantages of the skating rinks mentioned heretofore and many novel features that result in a new ice skating rink which is not anticipated, rendered obvious, suggested, or even implied by any of the prior art skating rinks, either alone or in any combination thereof.

It is another object of the present invention to provide a new ice skating rink which may be easily and efficiently manufactured and marketed.

It is a further object of the present invention to provide a new ice skating rink which is of a durable and reliable construction.

An even further object of the present invention is to provide a new ice skating rink which is susceptible of a low cost of manufacture with regard to both materials and labor, and which accordingly is then susceptible of low prices of sale to the consuming public, thereby making such ice skating rink economically available to the buying public.

Still yet another object of the present invention is to provide a new ice skating rink which provides in the apparatuses and methods of the prior art some of the advantages thereof, while simultaneously overcoming some of the disadvantages normally associated therewith.

Still another object of the present invention is to provide a new ice skating rink for easily and conveniently forming a sheet of ice for ice skating.

Yet another object of the present invention is to provide a new ice skating rink which includes a plurality of water holding trays disposed on the ground and connected together using connectors. When the water within the trays freezes a substantially continuous sheet of ice is formed.

Still yet another object of the present invention is to provide a new ice skating rink that retains water within receptacles, thus eliminating the constant watering required with conventional rinks.

Even still another object of the present invention is to provide a new Ice Skating Rink that can be connected together in different designs to vary the shape of the ice skating surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
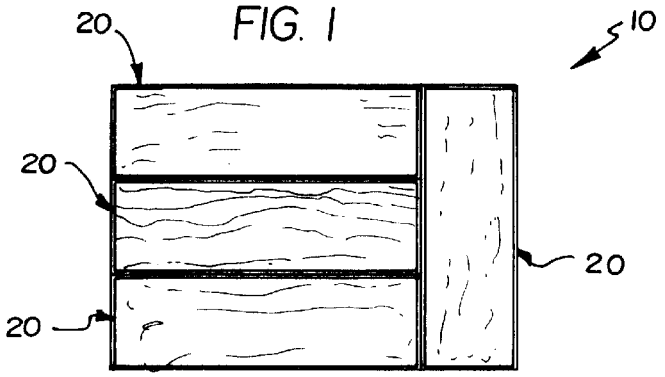
FIG. 1 is a top view of a plurality of trays connected together according to the present invention.

With reference now to the drawings, and in particular to FIGS. 1 through 6 thereof, a new ice skating rink embodying the principles and concepts of the present invention and generally designated by the reference numeral 10 will be described.

More specifically, it will be noted that the ice skating rink 10 comprises a plurality of trays 20 which are secured together using connectors 30.

As best illustrated in FIGS. 1 through 6, it can be shown that each tray 20 includes a bottom wall 21 and four side walls 22 extending upward from the bottom wall to define a receptacle 23. The receptacle 23 is designed to be filled with water which is then frozen to form a sheet of ice. The trays 20 are large enough so that when connected with other trays, a sheet of ice large enough for ice skating is formed. For instance, the trays can have a length of 15–30 feet, a width of 4 feet, and a height of about 6 inches, thus forming a sheet of ice which has substantially similar dimensions. These dimensions are purely exemplary, and other dimensions could be used. The trays are preferably formed of a plastic material, although other materials, such as metal, are contemplated.

Figure 3:
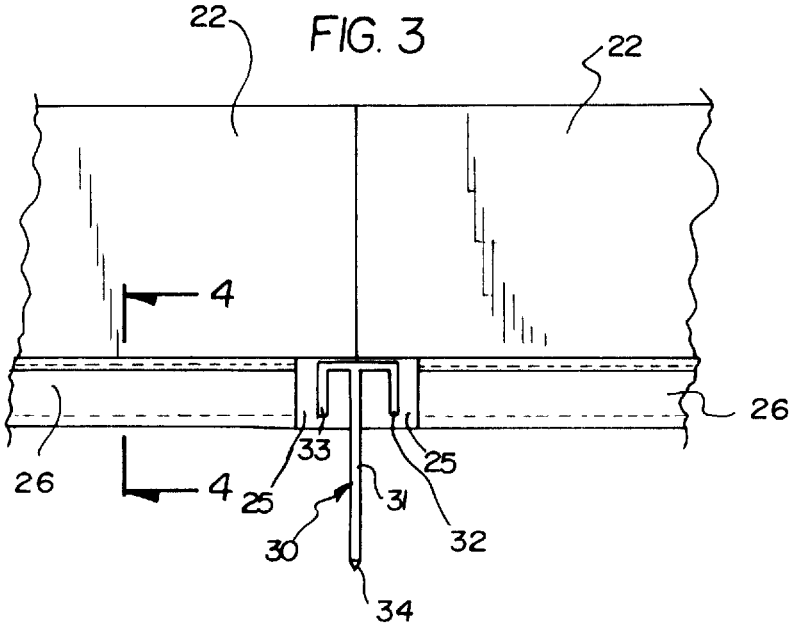
FIG. 3 is an end view taken along line 3—3 of FIG. 2.
Figure 6:
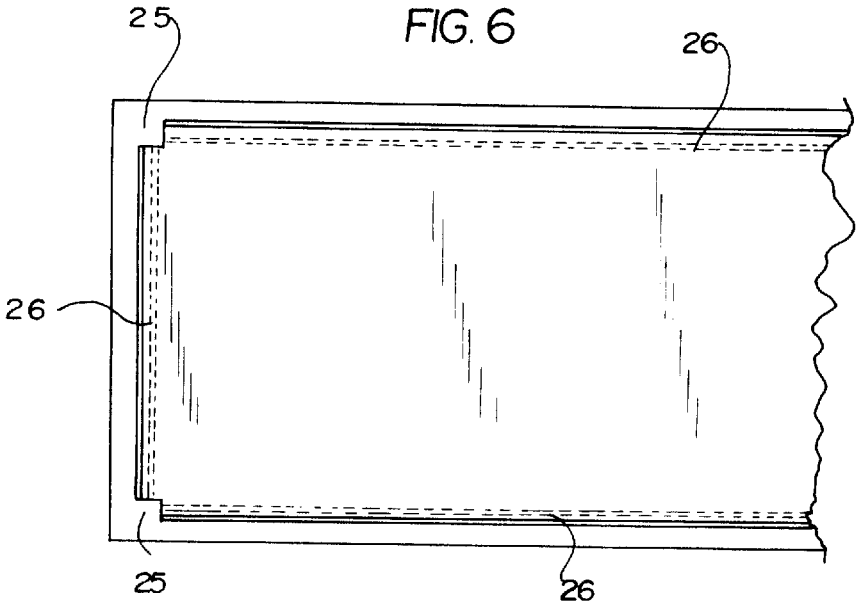
FIG. 6 is a bottom view of a portion of one of the trays showing the connection grooves in broken lines.

The bottom wall 21 of the tray includes a ground supported portion 27 and an overhanging shelf portion 28 along all four bottom edges of the tray. The portion of the bottom wall connecting the portions 27 and 28 is thickened as at 24. Each thickened wall portion 24 does not extend the entire length of the tray, but ends just before the corners of the tray. For instance, as seen in FIG. 3, the wall portion 24 of each tray ends before the tray corner to define recesses 25. Therefore, as best illustrated in FIG. 6, the corners of each tray include only the overhanging shelf portion 28, thus providing access to the grooves 26. Each corner of the tray includes such recesses 25, which permits insertion of connectors 30.

Figure 4:
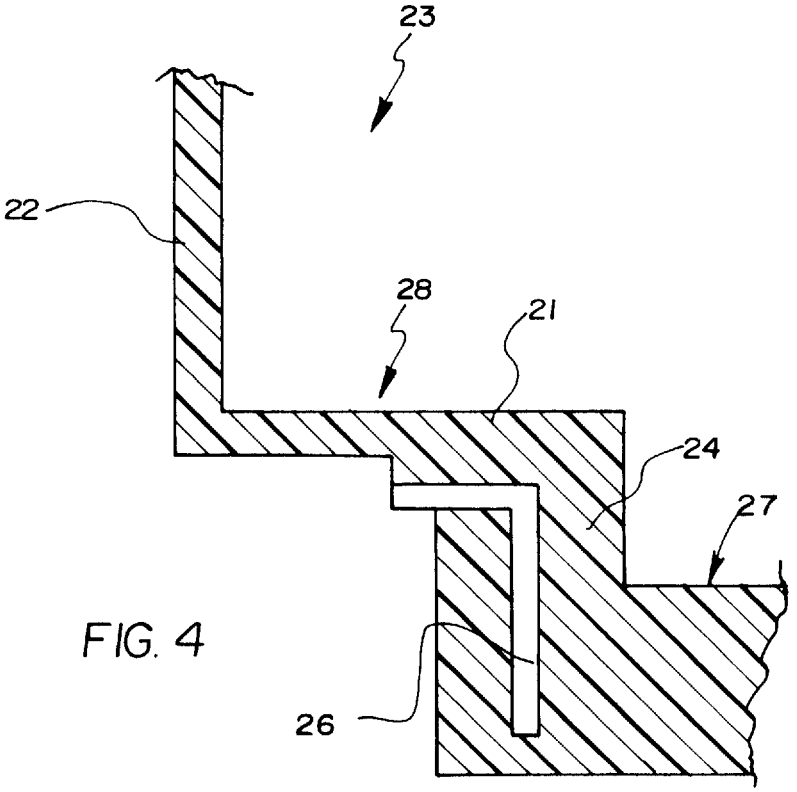
FIG. 4 is a cross sectional view taken along line 4—4 of FIG. 3.
Figure 5:
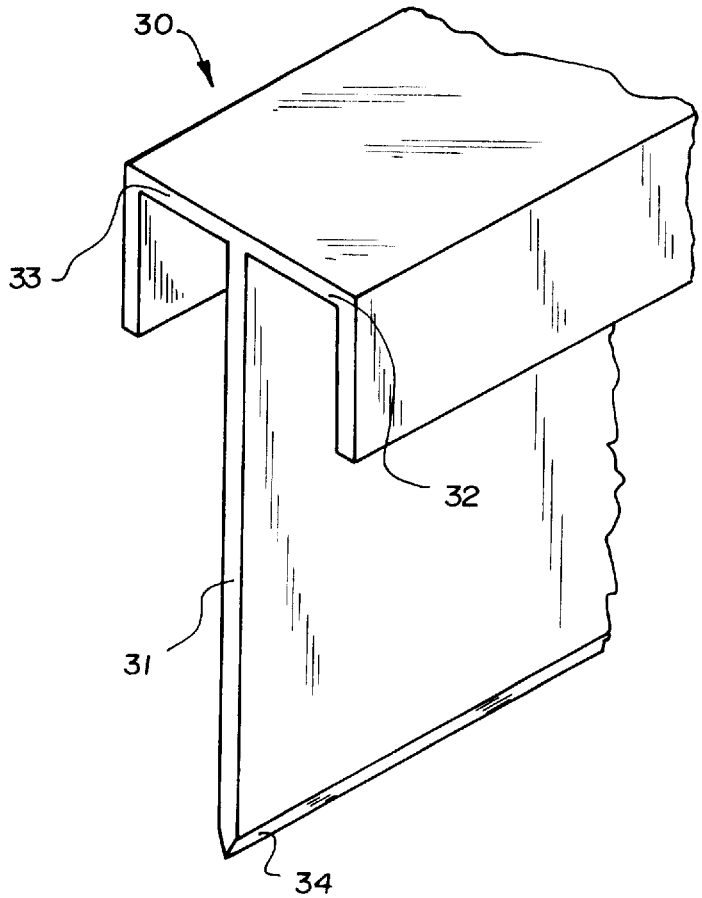
FIG. 5 is a perspective view of one of the connectors.

The thickened wall portions 24 include the longitudinal grooves 26 along the entire extent of the wall portions 24. FIGS. 3 and 6 show such grooves in dashed lines, while FIG. 4 shows one groove 26 in one wall portion 24. The other grooves are identical to the one shown in FIG. 4. The grooves are designed to receive one part of a connector 30.

Figure 2:
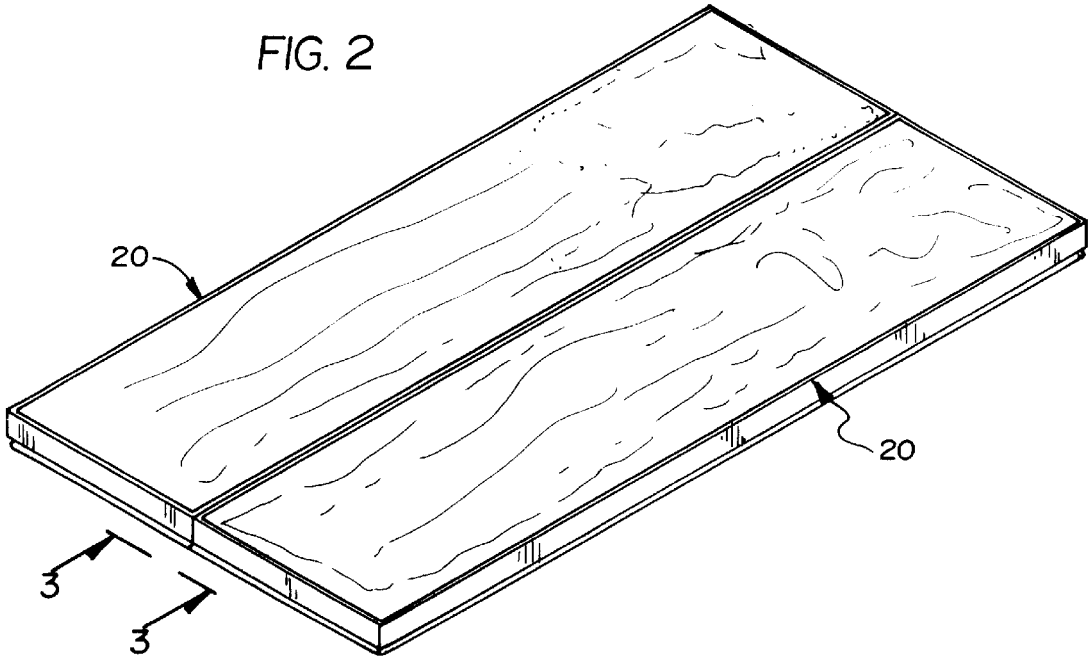
FIG. 2 is a perspective view of two trays connected side by side.

By disposing two trays next to each other, a connector 30 can be disposed within adjacent grooves 26 of the trays to connect the trays together. The connector 30 is generally "T" shaped, and includes a stem portion 31 and arms 32,33 extending from the stem portion. The stem portion includes a beveled tip 34, which facilitates insertion of the stem portion into the ground to anchor the trays. As illustrated in FIGS. 2 and 3, with two trays disposed side by side, a connector 30 is inserted into adjacent channels 26 and is disposed beneath the adjacent shelf portions 28, such that the arm 32 is inserted into the channel 26 of the right tray in FIG. 3, and the arm 33 is inserted into the channel 26 of the left tray, with the stem portion 31 disposed beneath the shelf portions 28. The stem portion 31 is then inserted into the ground to solidly anchor the trays. Each side of the trays is configured as described above, thus permitting any adjacent tray sides to be attached to each other to form different ice surface shapes.

In use, a plurality of trays are disposed on the ground. The number of trays used will depend upon the desired size of the ice surface. For instance, as illustrated in FIG. 1, four trays are used to form a rectangular ice sheet, with three trays laid side by side, and the fourth tray laid at the ends of the three trays. Connectors are then inserted into adjoining grooves 26 of adjoining trays, and the stem portions of the connectors are then driven into the ground to anchor the trays. The trays are then filled with water which is then allowed to freeze, thus forming a substantially continuous sheet of ice. If the ice should melt due to warm weather, the trays contain the water for later freezing, thus reducing the amount of water used. The trays can be connected side by side, end to end, or in any other configuration, to form different ice surfaces.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ice skating rink comprising:

a plurality of trays adapted for placement on a ground surface, each tray including a bottom wall and side walls extending upward from the bottom wall to define a receptacle for frozen water; and means for connecting the trays to each other to define a substantially continuous sheet of ice, wherein the connecting means includes L-shaped grooves formed in the bottom wall of each tray and a number of substantially T-shaped connectors, each T-shaped connector having a pair of L-shaped upper flanges disposed outwardly from a substantially vertical central flange, said pair of L-shaped upper flanges being disposed in adjacent grooves of adjoining trays so as to connect the adjoining trays together.

2. The ice skating rink of claim 1, wherein the central flange is adapted for insertion into the ground surface for attaching the plurality of trays to the ground.

3. The ice skating rink of claim 2, wherein the central flange includes a beveled tip being for facilitating insertion of the central flange into the ground.

4. An ice skating rink comprising:

a plurality of trays adapted for placement on a ground surface, each tray including a bottom wall and side walls extending upward from the bottom wall to define a receptacle for frozen water; and means for connecting the trays to each other to define a substantially continuous sheet of ice, wherein the connecting means includes L-shaped grooves formed proximate an outer perimeter of the bottom wall of each tray and a number of substantially T-shaped connectors, each T-shaped connector having a pair of L-shaped upper flanges disposed outwardly from a substantially vertical central flange, each of said pair of L-shaped upper flanges being slidably insertable into the L-shaped grooves of adjoining trays so as to connect the adjoining trays together;

wherein the central flange includes a beveled tip adapted for insertion into the ground surface for attaching the plurality of trays to the ground.

5. The ice skating rink of claim 4 wherein the bottom wall further comprises:

an overhanging shelf portion disposed from said side walls;

a thickened wall portion extending downwardly from said overhanging shelf portion, said L-shaped groove being positioned within said thickened wall portion; and a ground supported portion disposed from said thickened wall portion, said ground supported portion adapted to rest on the ground surface.

* * * * *